US006505422B2

(12) United States Patent
Racine

(10) Patent No.: US 6,505,422 B2
(45) Date of Patent: Jan. 14, 2003

(54) SKATE BOOT WITH TOE PROTECTOR

(75) Inventor: Bertrand Racine, Montreal (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/742,930

(22) Filed: Dec. 20, 2000

(65) Prior Publication Data

US 2001/0003876 A1 Jun. 21, 2001

(30) Foreign Application Priority Data

Dec. 21, 1999 (CA) ..... 2292994

(51) Int. Cl.[7] ..... A43B 5/16; A43C 13/14
(52) U.S. Cl. ..... 36/115; 36/77 R
(58) Field of Search ..... 36/115, 10, 77 R

(56) References Cited

U.S. PATENT DOCUMENTS

| | | | | |
|---|---|---|---|---|
| 26,329 | A | | 11/1859 | Silverthorn |
| RE1,339 | E | | 9/1862 | Allen |
| 607,623 | A | | 7/1898 | Neu |
| 1,982,725 | A | | 12/1934 | Clarke et al. |
| 1,986,580 | A | * | 1/1935 | Johnson ..... 280/11.3 |
| 2,177,542 | A | | 10/1939 | Tickelis |
| 2,219,123 | A | * | 10/1940 | Wold ..... 280/11.12 |
| 2,308,251 | A | * | 1/1943 | Terzi ..... 280/11.209 |
| 3,165,841 | A | | 1/1965 | Rollman |
| 4,353,173 | A | * | 10/1982 | Paquet ..... 36/115 |
| 4,870,762 | A | | 10/1989 | Lee |
| 4,964,229 | A | * | 10/1990 | Laberge ..... 12/142 P |
| 4,995,174 | A | | 2/1991 | Hong et al. |
| 5,074,060 | A | | 12/1991 | Brncick et al. |
| 5,342,070 | A | * | 8/1994 | Miller et al. ..... 280/11.231 |
| 5,566,476 | A | | 10/1996 | Bertrand et al. |
| 5,809,666 | A | | 9/1998 | Harwood |
| 5,878,511 | A | | 3/1999 | Krajcir |
| 5,887,361 | A | * | 3/1999 | Cabanis et al. ..... 36/115 |
| 5,933,987 | A | * | 8/1999 | Demarchi ..... 36/10 |
| 6,079,128 | A | * | 6/2000 | Hoshizaki et al. ..... 36/115 |

FOREIGN PATENT DOCUMENTS

| | | |
|---|---|---|
| AU | 157882 | 2/1954 |
| CA | 14990 | 6/1882 |
| CA | 182723 | 3/1918 |
| CA | 262880 | 7/1926 |
| CA | 273845 | 9/1927 |
| CA | 300838 | 6/1930 |
| CA | 327201 | 11/1932 |
| CA | 389376 | 6/1940 |
| CA | 783319 | 4/1968 |
| CA | 839484 | 4/1970 |
| CA | 2091932 | 9/1994 |
| CA | 2101719 | 1/1995 |
| CA | 2119837 | 9/1995 |

* cited by examiner

*Primary Examiner*—Ted Kavanaugh
(74) *Attorney, Agent, or Firm*—RatnerPrestia

(57) ABSTRACT

A skate boot featuring an exterior toe protector and a method of manufacture. The skate boot is provided with a toe cover adapted to be pulled and stretched over a last allowing the skate boot to be formed in a similar fashion as a skate boot featuring an interior toe protector. The toe protector has a pair of lateral extensions which overlap the frontal edges of the lateral supporting portions of the skate boot and a pair of cutout areas to surround the same lateral supporting portions of the skate boot.

14 Claims, 6 Drawing Sheets

SKATE BOOT WITH TOE PROTECTOR

FIELD OF THE INVENTION

The invention relates to skate boots, in particular to skate boots featuring an exterior toe protector, and to a method of manufacturing skate boots.

BACKGROUND OF THE INVENTION

Toe protectors are not new to the field of sports equipment and hockey in particular. Hockey skates are provided with a shell-like reinforcement in the toe region of the skate to prevent injuries. Canadian patent No. 839,484 discloses a skate boot construction including a toe cap. A molded convex dome-like shell is placed over the last and stapled to the insole of the boot; an upper toe covering flexible material is then placed over the last and over the toe cap and secured to the insole of the boot. This is the typical method of manufacturing a skate boot having a protective toe cap.

Most skate boots are normally manufactured in the following manner: A toe-cap is positioned on the last of the skate boot. A last is a three-dimensional shape of the inside cavity of the boot or shoe. A pre-assembled boot consisting of various pieces of fabric and/or leather is placed over the last and over the toe-cap. An insole is then placed on the bottom part of the last. The pre-assembled boot is stretched over the last and over the toe cap in order for the pre-assembled boot to conform to the specific shape of the last. The toe cap is therefore located inside the boot. The stretched material is then nailed or tacked and glued to the insole to maintain the desired shape. Once the upper part of the skate boot is completed, a rigid outsole is glued to the insole of the boot to complete the skate boot. An ice blade holder or an in-line roller chassis is then mounted to the rigid outsole to complete the skate.

More recently, skate boots have been made with the toe cap outside the skate boot. This method has the advantage of eliminating all material covering the toe cap of the skate boot. However, the stretching part of the manufacturing process had to be modified. The pre-assembled boot no longer required a toe cap covering material since it was no longer necessary to stretch this material over the toe cap. A tongue was sewn to the toe cap. The protective toe cap and tongue assembly was inserted between the sides of the pre-assembled boot and sewn to each side of the boot. The stretching over the last was done only along the sides and at the rear of the pre-assembled boot where material was then glued and nailed or tacked to the insole. Finally, an outsole was nailed and glued to the bottom of the skate boot covering the bottom of the toe cap previously installed.

The above described method of manufacturing a skate boot using an exterior toe cap produced an inferior formfitting skate boot in the frontal area of the foot. Skaters using skate boots having an exterior toe cap often complained about poor frontal fitting of this type of skate boot. The frontal area of the skate boot was not being stretched properly and the result was a somewhat awkward fitting skate, which was either too tight or too loose.

Thus, there is a need in the industry for a skate boot featuring an outside toe protector which has equal formfitting qualities as a traditionally made skate boot.

OBJECTS AND STATEMENT OF THE INVENTION

It is thus an object of the invention to provide a skate boot having an outside toe protector that has equal formfitting qualities as a traditionally made skate boot.

It is another object of the invention to provide a skate boot construction adapted to increase the frontal formfitting of a skate boot.

It is a further object of the invention to provide a method of making a skate boot having an outside toe protector which has a good frontal form fit.

As embodied and broadly described herein, the invention provides a skate boot comprising an upper for supporting and enclosing a skater's foot. The upper has a heel counter, an ankle support, a medial quarter and a lateral quarter, each quarter having a frontal edge; the medial and lateral quarters extending forwardly from the heel counter and the ankle support. An insole forms the bottom of the upper and a toe cover defining a toe box for covering the toe area of the skaters foot, is connected to the frontal edges and to the insole. A tongue is connected to the toe cover for cushioning and covering the upper frontal part of the skaters foot and ankle. The skate boot also comprises a preformed toe protector overlying the toe cover and secured to the upper. The toe protector has a convex upper portion covering the front, the top and the sides of the toe cover. The toe protector also has an anchoring portion for securing the toe protector to the upper.

Preferably, the toe protector further comprises a tab extending inwardly from each lateral extensions for fastening the toe protector to the insole of the upper. Also, the toe protector comprises cut-out areas adapted to surround the frontal edges of the medial and lateral quarters to allow some degree of motion to these quarters.

Advantageously, the toe cover comprises at least two superposed layers: a first layer of smooth material facing the inside of the skate boot and a second layer of a textile material over the first layer and adapted to resist tension.

As embodied and broadly described herein, the invention also provides a method of making a skate boot comprising the steps of:

a) stretching over a last an upper having a toe cover, a heel counter, an ankle support, an insole, a medial quarter and a lateral quarter;

b) folding the edges of said upper underneath said insole on said last and fastening said edges to said;

c) affixing a preformed toe protector over said toe cover, said toe protector having a convex upper portion covering the front, the top and the sides of said toe cover and an anchoring portion for securing said toe protector to said insole;

d)simultaneously urging both sides said toe protector toward said medial and lateral quarters and fastening said anchoring portion of said toe protector to said insole.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
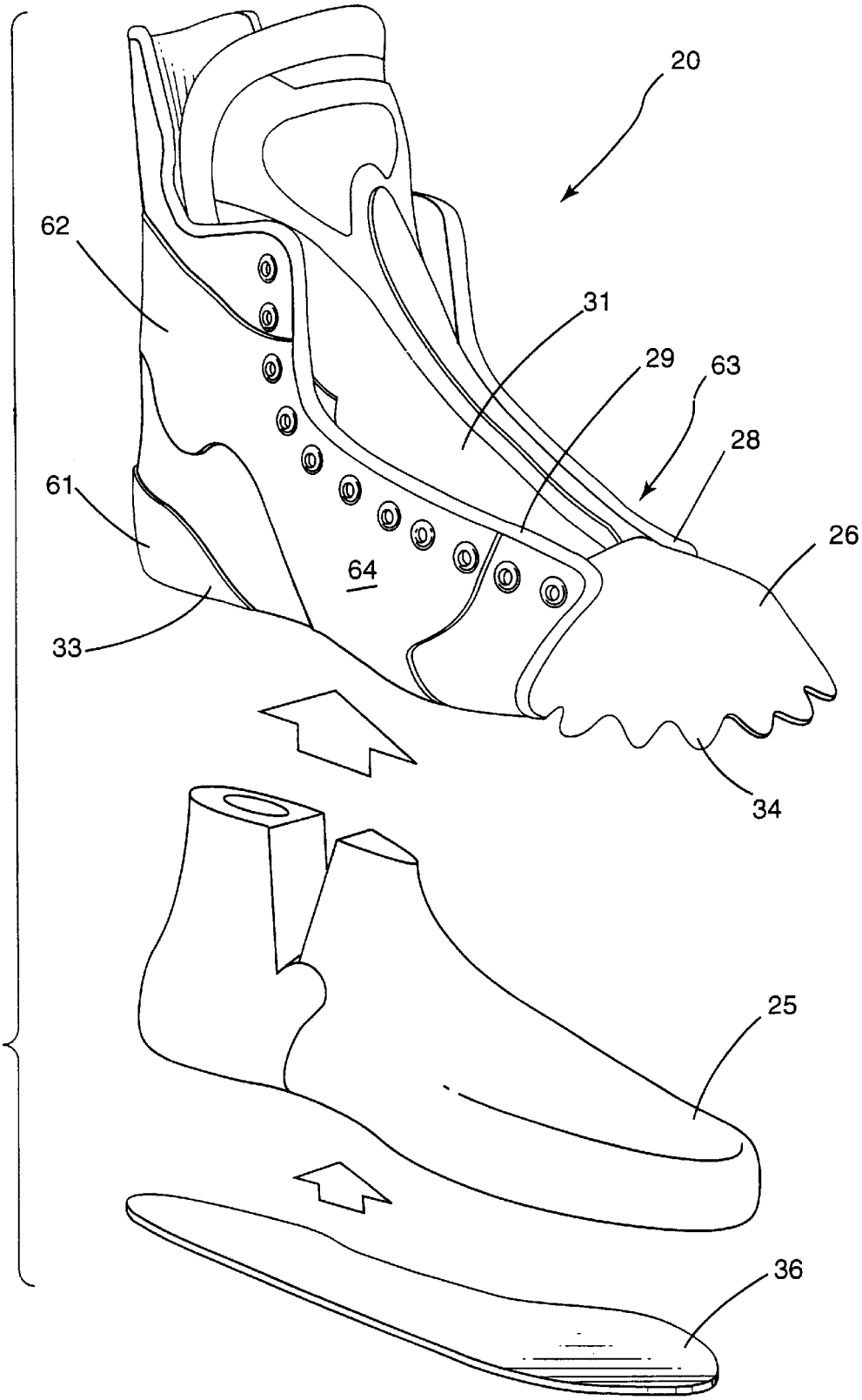
FIG. 1 is a perspective view of the first step of a method of making a skate boot according to the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIG. 1 illustrates a pre-assembled upper 20 for making a skate boot. Pre-assembled upper 20 basically comprises a heel counter 61, an ankle support 62, a medial quarter 63 and a lateral quarter 64. Each quarter 63 and 64 has a frontal edge 28 and 29 and extends from the heel counter 61 and the ankle support 62 to the front of the upper 20. At the front, a toe cover 26 made of a soft textile material covers the toe area of the skater's foot and is sewn on each side to frontal edges 28 and 29. A tongue 31, for cushioning and covering the upper frontal part of the skater's foot and ankle, is also sewn to the upper edge of toe cover 26 in a manner enabling tongue 31 to be flipped up and down to open the skate boot and allow the skater to easily insert his or her foot into upper 20.

Pre-assembled upper 20 is made of various pieces of leather, fabric or textile sewn and glued together prior to being formed as pre-assembled upper 20. FIG. 1 illustrates the first step of the making of a skate boot once pre-assembled upper 20 is completed. A Last 25 is inserted into pre-assembled upper 20 and an insole 36 is positioned over the lower end of last 25 once last 25 is inside pre-assembled upper 20. Medial and lateral quarters 63 and 64 have a sufficient marginal edge 33 that exceeds all around last 25 to provide a gripping and pulling means to stretch upper 20 over last 25. Similarly, toe cover 26 has a marginal edge 34 that exceeds the front portion of last 25 to provide the necessary gripping and pulling means to stretch toe cover 26 over the front portion of last 25. Marginal edges 33 and 34 provide the necessary hold for pre-assembled upper 20 to be stretched over a last 25.

Figure 2:
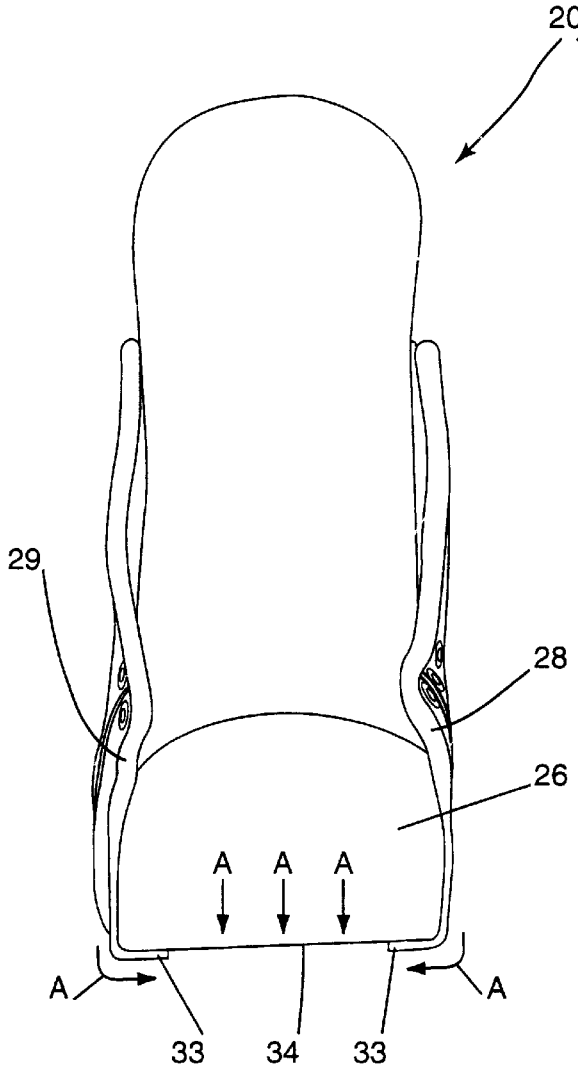
FIG. 2 is a front elevational view of the second step of a method of making a skate boot according to the invention.
Figure 3:
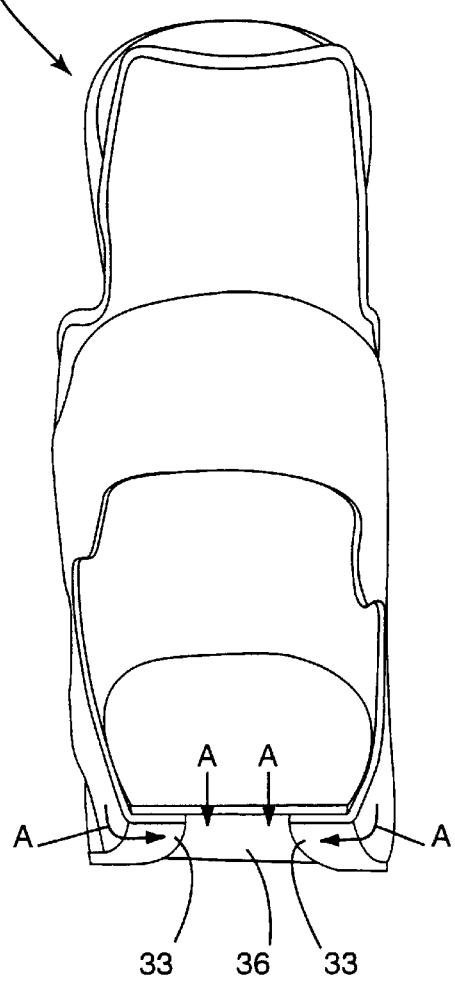
FIG. 3 is a rear elevational of the second step of a method of making a skate boot according to the invention.

FIGS. 2 and 3 illustrate the second step of making of a skate boot and shows last 25 inside upper 20 and insole 36 in position. Glue is first applied along the sides of insole 36. Marginal edges 33 and 34 of pre-assembled upper 20 are then pulled and stretched tightly over last 25 and folded underneath insole 36 as depicted by the arrows A. Once folded, marginal edges 33 and 34 adhesively bond to insole 36 with the glue that was previously laid on insole 36. Note that toe cover 26 is made of a material strong enough to resist the traction force of the stretching. Toe cover is preferably constructed of three layers of material: A first layer of smooth textile material on the inside of the boot which will be in contact with the skater's foot, a second layer consisting of a thin plastic sheet adapted to retain the shape given by the last 25, and a third layer of a nylon textile which can resist the traction force during the lasting process. The addition of toe cover 26 to the construction of a skate boot having a external toe protector enables the entire pre-assembled upper 20 to be properly stretched over last 25 which will provide a good fitting of the final product. The pulling and stretching may be accomplished by hand using traditional shoe maker tools or can be automated to provide an even tension of the material over last 25 which results in a better quality skate boot.

Figure 4:
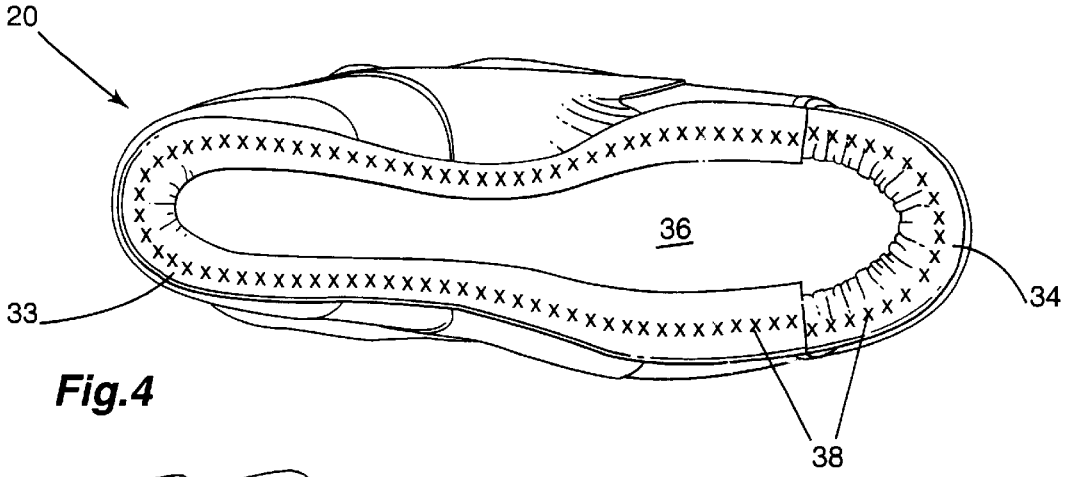
FIG. 4 is a bottom plan view of the third step of a method of making a skate boot according to the invention.

As shown in FIG. 4, while being stretched and pulled, marginal edges 33 and 34 are further nailed or tacked all around insole 36 with nails or tacks 38. Nails 38 provide the necessary mechanical grip to remove the pulling forces and allow the glue to properly set between marginal edges 33 and 34 and insole 36. Once marginal edges 33 and 34 are fully stretched and firmly attached to insole 36, a light sanding of the marginal edges 33 and 34 is performed to partially even the lower surface of upper 20 and provide a flat surface on which an outsole can later be glued and nailed.

Figure 5:
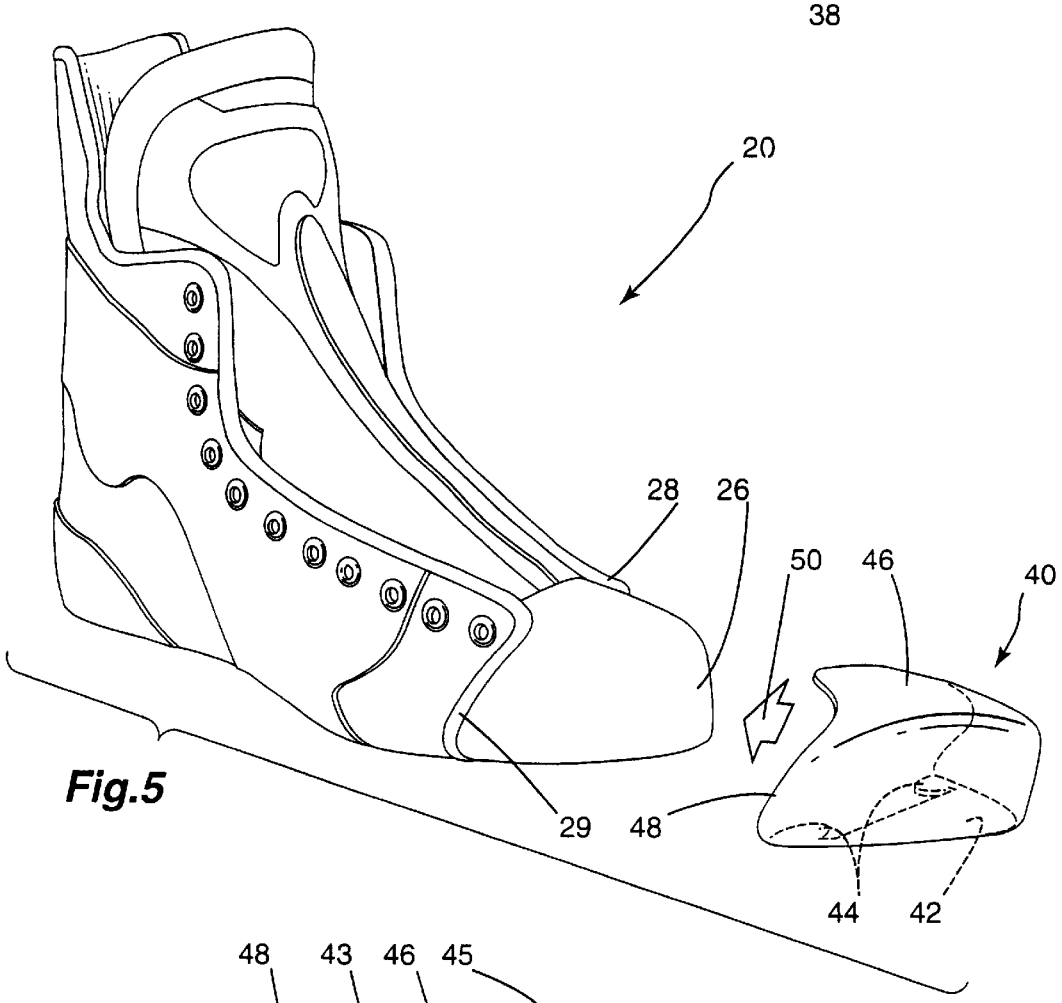
FIG. 5 is a perspective view of the fourth step of a method of making a skate boot according to the invention.
Figure 6:
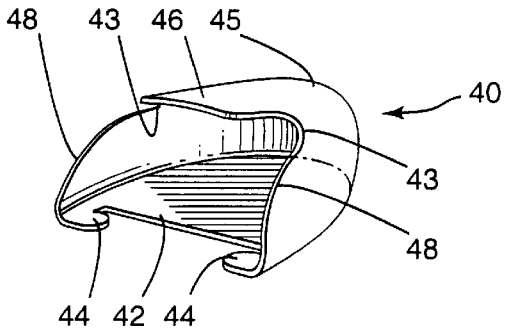
FIG. 6 is an inside perspective view of a toe protector according to the invention.

FIG. 5 shows upper 20 in its final form. Toe cover 26 is stretched around insole 36 and shaped to define a toe box covering the toe area of the foot. Both lateral and medial quarters 63 and 64 are also stretched around insole 36 and shaped to support each side of the foot. A toe protector 40 is then positioned over toe cover 26 as represented by arrow 50. Prior to positioning toe protector 40, a layer of glue may be applied to toe cover 26 to ensure that cover 26 adheres to the interior wall of toe protector 40. However toe cover 26 may also not be glued to the interior surface of toe protector 40 and remain loose inside the skate boot. As shown in FIGS. 5 and 6, toe protector 40 is a convex structure made of a highly resistant plastic such as nylon or polyurethane which are both rigid and light. Toe protector 40 features a generally planar lower insole contacting portion 42 or anchoring portion conforming to the frontal lower surface of upper 20 and flanked by a pair of tabs 44 extending from lower portion 42. Lower portion 42 preferably extends over the entire frontal area of insole 36 but may also only extend along the edge of insole 36 leaving the center portion uncovered. In this manner, toe protector 40 is more flexible and can adapt to various widths.

The upper portion 45 that will cover the toe area of pre-assembled upper 20 features an upper extension 46 and two lateral extensions 48. Each lateral extension 48 preferably includes a tab 44 adjacent lower portion 42 of toe protector 40. Cutout areas 43 are provided in between lateral extensions 48 and upper extension 46 to enable toe protector 40 to surround edges 28 and 29. Toe protector 40 is of course hollow to fit over toe cover 26 of pre-assembled upper 20.

Figure 7:
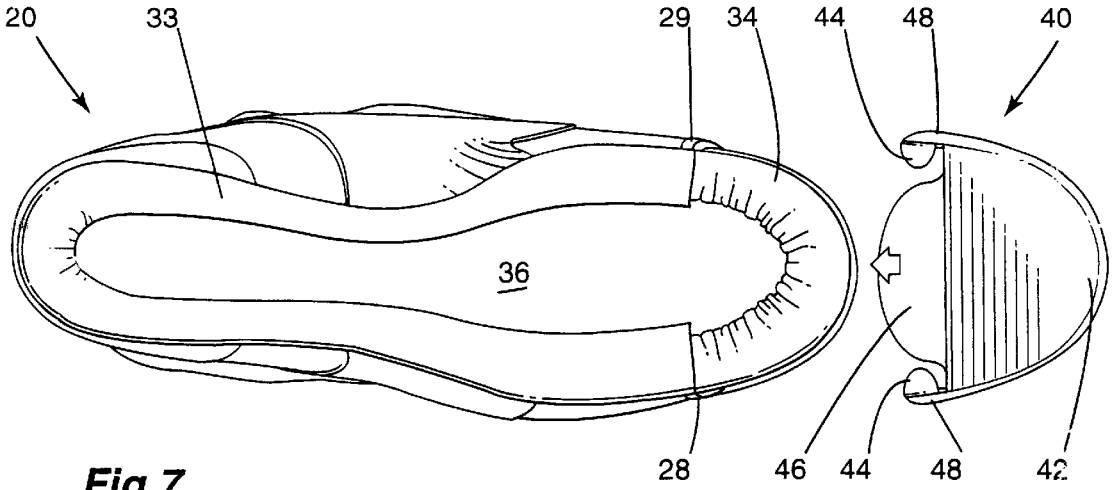
FIG. 7 is a bottom plan view of the fourth step of a method of making a skate boot according to the invention.
Figure 8:
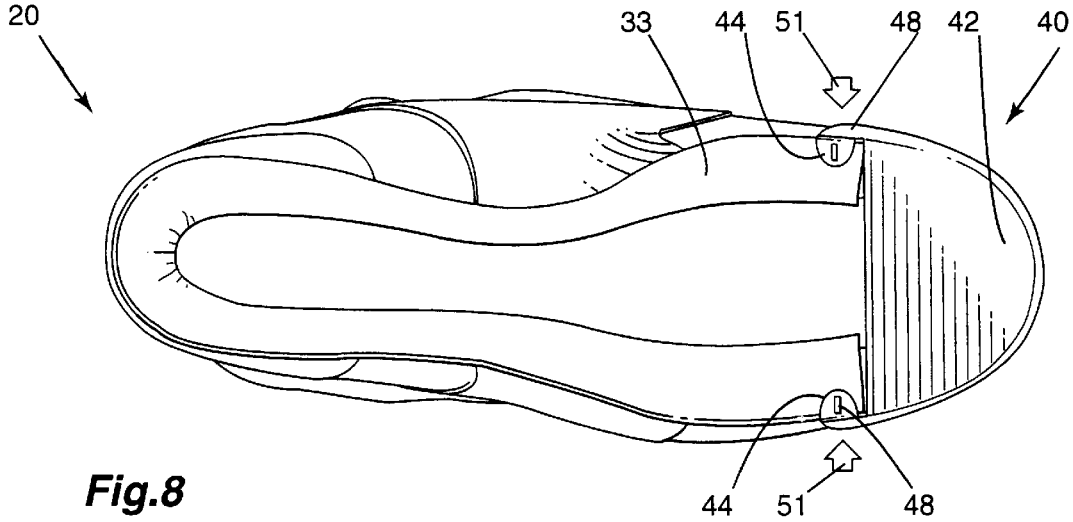
FIG. 8 is a bottom plan view of the fifth step of a method of making a skate boot according to the invention.

FIG. 7 illustrates the same sequence as FIG. 5 but viewed from underneath. A layer of glue is also applied to marginal edge 34. Toe protector 40 is slipped over the toe area of pre-assembled upper 20 and more specifically over toe cover 26 and the frontal part of insole 36. Toe protector 40 is bonded to marginal edge 34 underneath pre-assembled upper 20 and is sometime glued to toe cover 26. As shown in FIG. 8, once toe protector 40 has been positioned over toe cover 26, mechanical pressure, depicted by arrows 51, is applied on both sides of toe protector 40 to each lateral extension 48. While the mechanical pressure 51 is applied, tabs 44 are tacked onto insole 26 through marginal edge 33. This step results in lateral extensions 48 being tightly pressed against the exterior of each frontal edge 28 and 29 of pre-assembled upper 20.

Figure 9:
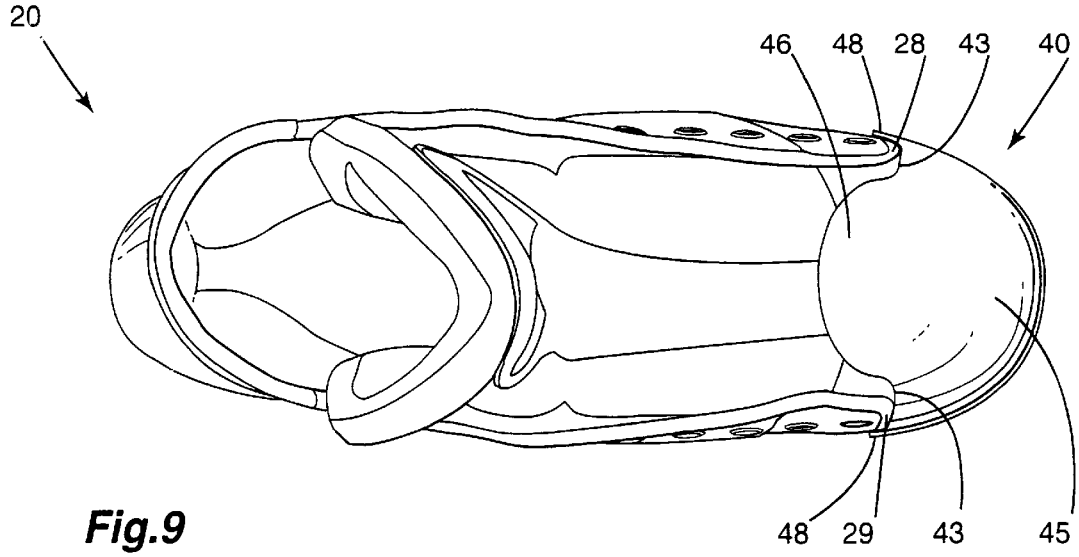
FIG. 9 is a top plan of view of a skate boot after the fifth step is completed according to the invention.
Figure 10:
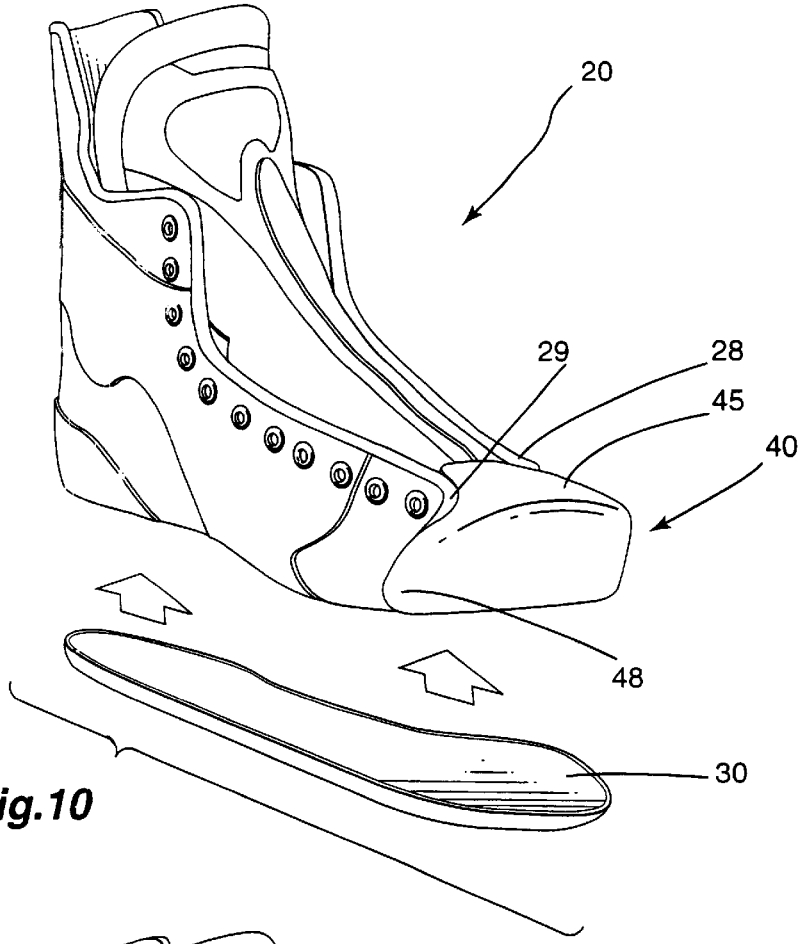
FIG. 10 is a perspective view of the sixth and final step of a method of making a skate boot according to the invention.

As shown in FIGS. 9 and 10, toe protector 40 is installed onto pre-assembled upper 20 in such a way that lateral extensions 48 overlap each frontal edge 28 and 29. Since the entire pre-assembled upper 20 has been stretched to provide a proper form fit, toe protector 40 cannot be inserted between toe cover 26 and edges 28 and 29. Cutout areas 43 of toe protector 40 are provided to surround frontal edges 28 and 29 and allow some degree of lateral motion to medial and lateral quarters 63 and 64.

Finally, as shown in FIG. 10, an outsole 30 is nailed and glued to the bottom of pre-assembled upper 20 in order to complete the skate boot. It must be noted that the use of outsole 30 is optional since an ice blade holder or an in-line roller chassis having an integrated rigid platform conforming to the lower surface of upper 20 may be affixed to pre-assembled upper 20 rendering the outsole redundant. Outsole 30 is used when the blade holder or the in-line roller chassis requires a rigid platform for fastening.

Figure 11:
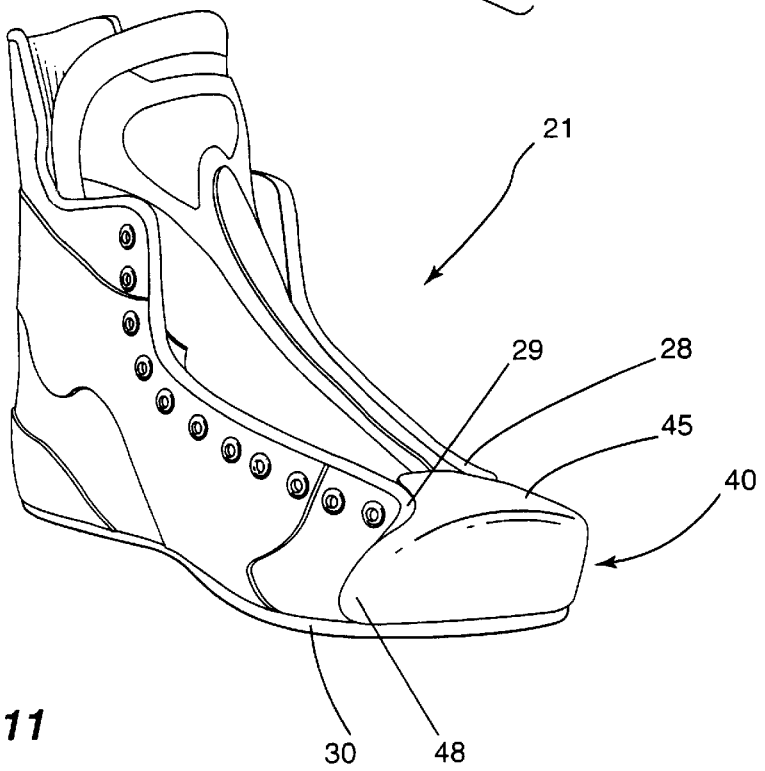
FIG. 11 is perspective view of the completed skate boot made according to the invention.
Figure 12:
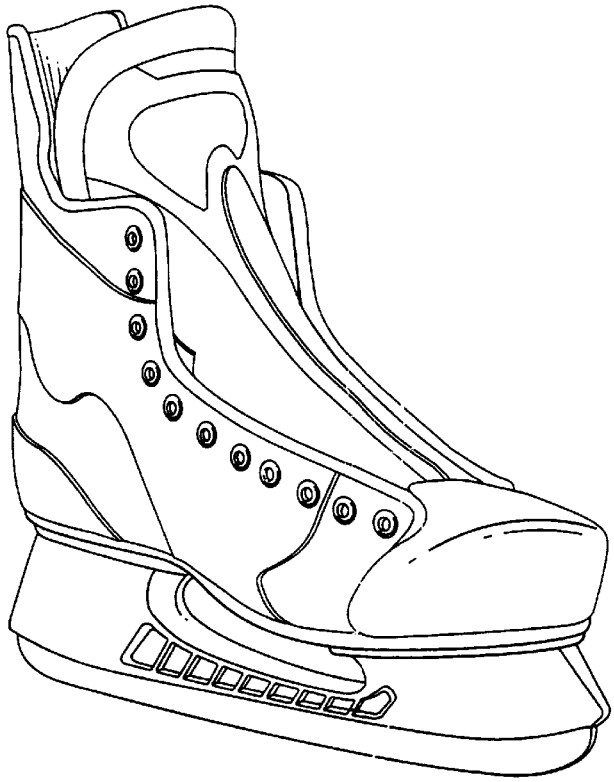
FIG. 12 is a perspective view of the completed ice skate made according to the invention.
Figure 13:
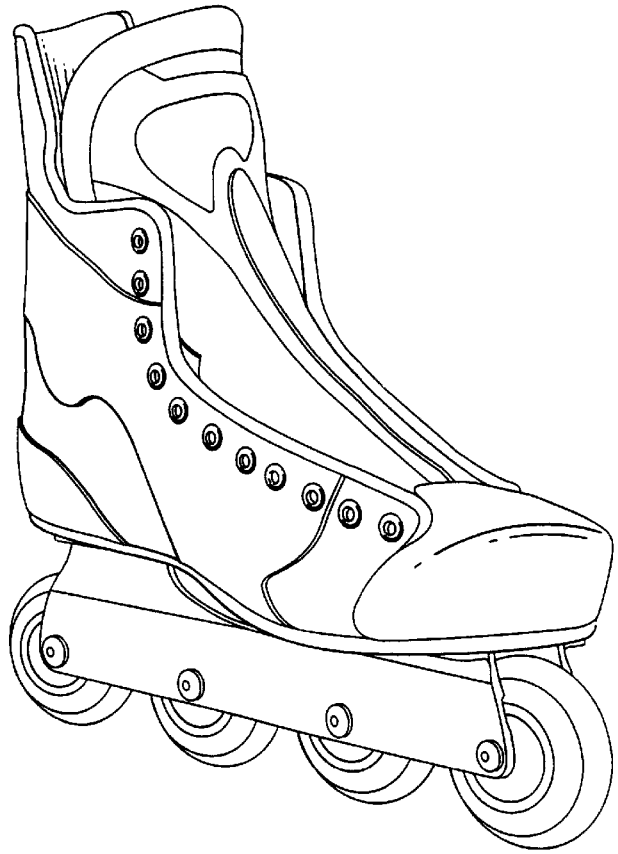
FIG. 13 is a perspective view of the completed in-line roller skate made according to the invention.

FIG. 11 illustrates a finished skate boot 21. The only step left to complete the skate is to mount an ice blade assembly or an in-line roller chassis assembly to outsole 30 by fastening it to the outsole 30 as shown in FIGS. 12 and 13. It should be noted that toe cover 26 further provides a more comfortable toe area for the skater. A normal skate boot does not have a textile cover in the toe region of the boot so the toes of the skater are directly in contact with the plastic toe cap.

The above description of preferred embodiments should not be interpreted in a limiting manner since other variations, modifications and refinements are possible within the spirit and scope of the present invention. The scope of the invention is defined in the appended claims and their equivalents.

The embodiments of the invention for which an exclusive privilege or property is claimed are defined as follows:

1. A lasted skate boot for enclosing a human foot, the foot having a heel, an ankle, a plantar surface, a medial side, a lateral side and toes, said skate boot comprising an upper including:

(a) medial and lateral quarters receiving medial and lateral sides of the foot respectively, each quarter having a frontal edge;

(b) an insole facing the plantar surface of the foot;

(c) an inner toe cover and an outer toe protector more rigid than said inner toe cover, said inner toe cover having a front portion, a top portion and sides defining a toe box covering the toes of the foot, said inner toe cover being affixed to said frontal edges of said medial and lateral quarters, said inner toe cover having a marginal edge folded and at least partially overlapping said insole;

(d) said outer toe protector having a front portion, an upper extension and two lateral extensions, said upper and lateral extensions projecting rearwardly from said front portion, said front portion and upper and lateral extensions of said outer toe protector facing said front, top and sides of said inner toe cover respectively, said lateral extensions of said outer toe protector being adjacent to said frontal edges of said medial and lateral quarters.

2. The lasted skate boot as defined in claim 1, wherein said outer toe protector further comprises a lower insole contacting portion for securing said outer toe protector to said insole.

3. The lasted skate boot as defined in claim 2, wherein said lower insole contacting portion comprises an anchoring portion for securing said outer toe protector to said insole.

4. The lasted skate boot as defined in claim 3, wherein said anchoring portion comprises a tab extending inwardly, said tab being affixed to said insole with a fastener.

5. The lasted skate boot as defined in claim 4, wherein said fastener is a tack affixing said tab, said marginal edge of said inner toe cover, and said insole.

6. The lasted skate boot as defined in claim 1, wherein said inner toe cover comprises first and second layers, said first layer contacting the foot and said second layer being more rigid that said first layer.

7. The lasted skate boot as defined in claim 1, wherein said inner toe cover comprises first, second and third layers, said first layer contacting the foot, said second layer being made of plastic, and said third layer being made of nylon.

8. The lasted skate boot as defined in claim 1, wherein said outer toe protector is molded of synthetic material.

9. The lasted skate boot as defined in claim 1, wherein said outer toe protector is made of molded plastic.

10. The lasted skate boot as defined in claim 1, wherein said upper further comprises a tongue affixed to said inner toe cover.

11. The lasted skate boot as defined in claim 1, wherein said upper further comprises a heel counter receiving the heel of the foot and an ankle support receiving the ankle of the foot.

12. The lasted skate boot as defined in claim 1, wherein said skate boot further comprises an outsole secured to said insole.

13. An ice skate comprising the lasted skate boot as defined in claim 1.

14. An in-line roller skate comprising the lasted skate boot as defined in claim 1.

* * * * *